United States Patent [19]

Benckendorff et al.

[11] 4,274,086

[45] Jun. 16, 1981

[54] SECURITY ALARM SYSTEM

[75] Inventors: Wolfgang Benckendorff, Peissenberg; Hans Kübler, Munich, both of Fed. Rep. of Germany

[73] Assignee: Siemens Aktiengesellschaft, Berlin & Munich, Fed. Rep. of Germany

[21] Appl. No.: 53,685

[22] Filed: Jul. 2, 1979

[30] Foreign Application Priority Data

Aug. 3, 1978 [DE] Fed. Rep. of Germany ..... 2834143

[51] Int. Cl.[3] ..... G08B 23/00; G08B 17/00

[52] U.S. Cl. ..... 340/506; 340/508; 340/518; 340/531; 340/533; 340/537; 307/10 AT; 324/66; 339/198 R; 174/112; 179/175.3 A

[58] Field of Search ..... 340/506, 508, 531, 532, 340/533, 536, 537, 543, 518, 505, 510, 511, 512–517; 307/10 AT; 324/66; 339/198, 113 R, 113 B, 113 L; 174/112; 179/175.3 A

[56] References Cited

U.S. PATENT DOCUMENTS

| | | | |
|---|---|---|---|
| 2,106,048 | 1/1938 | Candy | 174/112 |
| 2,945,204 | 7/1960 | Berger | 339/113 B |
| 3,404,393 | 10/1968 | Blivice et al. | 340/506 |
| 3,644,927 | 2/1972 | Green | 340/537 |
| 3,988,724 | 10/1976 | Anderson | 340/539 |
| 4,032,916 | 6/1977 | Galvin et al. | 340/533 |
| 4,161,727 | 7/1979 | Thilo et al. | 340/518 |
| 4,162,489 | 7/1979 | Thilo et al. | 340/518 |

*Primary Examiner*—John W. Caldwell, Sr.
*Assistant Examiner*—Donnie Lee Crosland
*Attorney, Agent, or Firm*—Hill, Van Santen, Steadman, Chiara & Simpson

[57] ABSTRACT

In an alarm system, differently colored leads of the connection cable between the individual distributors are respectively assigned to different current paths according to a random sequence. By providing this association, targeted manipulations at the connection lines of the signal lines are prevented.

4 Claims, 1 Drawing Figure

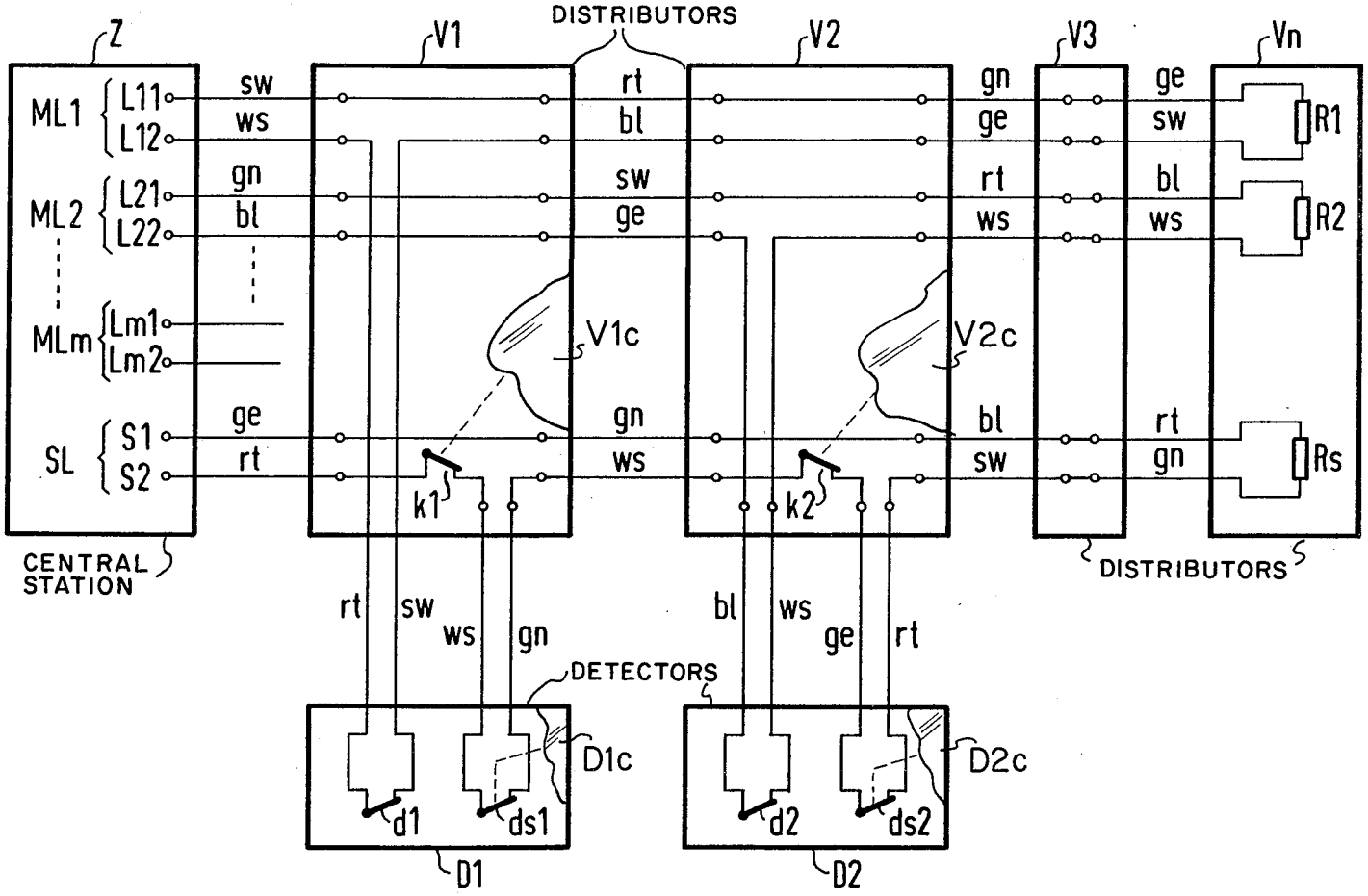
Z
ML1
L11
L12
ML2
L21
L22
MLm
Lm1
Lm2
SL
S1
S2
CENTRAL STATION
sw
ws
gn
bl
ge
rt
V1
V2
V3
Vn
DISTRIBUTORS
V1c
V2c
k1
k2
R1
R2
Rs
DETECTORS
D1c
D2c
D1
D2
d1
d2
ds1
ds2

SECURITY ALARM SYSTEM

BACKGROUND OF THE INVENTION

1. Field of the Invention

The present invention relates to a security alarm system having a plurality of signal lines with respectively two or more current paths proceeding from a central station, which current paths are conducted by way of dividers for the connection of respectively one or more detectors, whereby the individual current paths from divider to divider or, respectively, from a respective divider to the individual detectors are formed by means of different colored leads of a cable.

2. Description of the Prior Art

Systems of the type mentioned above are conventional. In such systems, leads of a cable having different colors are employed for identifying the individual current paths in order to achieve a targeted interconnection of the individual signal lines during the construction of the system and to be able to properly connect the individual alarms, on the one hand, and, on the other hand, to be able to identify individual current paths in each line section upon disruptions. Indeed, this identification of the individual current paths in burglar alarm systems facilitates the targeted manipulation of the system. Therefore, for example, by means of short-circuiting specific line sections, specific detectors may be made ineffective. In order to prevent this, in known systems having lines monitored by quiescent current, terminal resistances are mounted in each detector. If such a detector is short-circuited, then the resistance change on the line leads to an alarm actuation in the central station. However, the maximum number of detectors which can be connected to a line is limited by the size of the terminal resistances.

SUMMARY OF THE INVENTION

The object of the present invention, therefore, is to provide a security alarm system of the type generally mentioned above so as to be sabotage-proof, without a necessity of equipping the individual detectors with additional devices, such as terminal resistances, for this purpose.

The above object is achieved, in accordance with the present invention, in that the individual line leads which are identified with specific colors have respectively different current paths allocated thereto in each cable section, according to a random distribution. By means of this change of the color assignment in the cable sections between the distributors, an outsider can no longer recognize an identification of the individual lines, the line characterization is retained for assembly and maintenance, since the color distribution is selected upon installation of the system can be determined and stored for each line section.

Since the wiring in the individual distributors is fixed, under certain conditions a specific current path could be followed by opening all distributors; this, however, is generally too much trouble for an unauthorized intruder who is subject to the pressures of time. However, this possibility, also, can be eliminated when, in a manner known per se, a sabotage line is conducted through all distributors which, when the distributor is opened, leads to an alarm indication in the central station.

BRIEF DESCRIPTION OF THE DRAWING

Other objects, features and advantages of the invention, its organization, construction and operation will be best understood from the following detailed description, taken in conjunction with the accompanying drawing, on which there is a single FIGURE which is a schematic representation of an alarm system constructed in accordance with the present invention.

DESCRIPTION OF THE PREFERRED EMBODIMENT

Referring to the drawing, an organization of a burglar alarm system is illustrated, comprising a central station Z to which various single lines ML1–MLm are connected. Devices for line monitoring, as well as for alarm emission and display, are provided in the central station in the usual manner. In the example illustrated on the drawing, signal lines monitored with quiescent current are provided, each of which has two current paths, i.e. signal line ML1 with the current paths L11 and L12, the signal line ML2 with the current paths L21 and L22, etc. Depending on the system, more lines per signal line can also be provided. A sabotage line SL with the two current paths S1 and S2 is also connected, in addition to the signal lines.

The current paths of the individual signal lines ML and of the sabotage line SL are relayed proceeding from the central station Z by way of a plurality of distributors V1, V2, etc., up to the last distributor Vn. In the last distributor Vn, the current loop of each signal line is closed by way of a terminal resistance R1, R2, etc. In the central station Z, a specific voltage is then applied in each signal line so that a quiescent current of a specified magnitude flows over the respective terminal resistance. In this manner, each line interruption, as well as each line short-circuit, is recognizable in the central station by means of a current measurement.

Detectors are connected to the individual distributors V1, V2 . . . . Vn. Therefore, for example, a detector D1 is connected with its alarm contact d1 in the current path L12. A detector D2 has its alarm contact d2 connected in the current path L22. When the detector response, the contact concerned is respectively opened; this is recognized in the signal line concerned as a line disconnection. Moreover, the sabotage line has a sabotage contact k or, respectively, ds in each distributor V and in each detector D. These sabotage contacts respectively open when manipulations are carried out on the distributor or on the alarm detector, i.e. when the housing is opened. The distributors V1 and V2 have been illustrated with their covers V1c and V2c, respectively, shown mostly broken away and mechanically linked to the respective sabotage contacts k1 and k2, respectively. In the same manner, the detectors D1 and D2 have their covers D1c and D2c, respectively, shown mostly broken away and mechanically linked to the respective sabotage contacts ds1 and ds2, respectively.

The relaying of the individual current paths from the central station to the distributors, between the distributors and from the distributors to the detectors occurs by way of cable whose individual leads bear different colors. On the drawing, for example, these colors are designated with sw (black), ws (white), gn (green), bl (blue), ge (yellow) and rt (red). Depending on the number of current paths, correspondingly more colors or color combinations can be employed. The allocation of the individual colors to a specific current path, however, varies in each cable section. Therefore, the current path L12 between the central station Z and the distributor V1 is wired with a white lead, with a red lead and a black lead from the distributor V1 to the detector D1, with a blue lead from the distributor V1 to the distributor V2, etc. The sequence of the colors at the individual distributor connections varies in each cable section in a different manner. For example, the sequence of colors can be determined by means of a random numbered generator.

In this manner, it is impossible for an unauthorized person to follow the allocation of the individual cable leads to a specific detector or to a specific signal line without opening a distributor housing and, therefore, triggering an alarm by way of the sabotage line. However, it is nonetheless possible for the assembly and the maintenance of the system to record the allocation of the individual cable leads in each section to specific current paths and to store the same in lists or in some other manner.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In an alarm system of the type in which a plurality of current paths extend as alarm lines from a central station to a plurality of detectors by way of a plurality of distributors, and in which the current path alarm lines are defined by a first cable section extending between the central station and a first distributor, a plurality of second cable sections extending between adjacent distributors, and a plurality of third cable sections extending between the distributors and respective detectors, and in which the cable sections have color-coded conductors therein for the alarm lines, the improvement wherein:

the color-coded conductors of each of the cable sections being randomly interconnected with different color-codes connected to one another such that each color-coded conductor of each cable section defines a different current path alarm line between their respective system elements connected thereby.

2. The improved alarm system of claim 1, wherein:

each of said distributors includes a housing having a cover; and one of said current paths is a sabotage current path and includes a sabotage element operated by opening of the housing cover to trigger an alarm.

3. The improved alarm system of claim 1, wherein:

each of said detectors includes a housing having a cover; and one of said current paths is a sabotage current path and includes a sabotage element operated by opening of the housing cover to trigger an alarm.

4. The improved alarm of claim 1, wherein:

each of said distributors includes a housing having a cover;

each of said detectors includes a housing having a cover; and one of said current paths is a sabotage current path and includes a first sabotage element in each of said distributors and a second sabotage element in each of said detectors, said sabotage elements being operated by opening of the respective housing cover to trigger an alarm.

* * * * *